United States Patent [19]

Barnewall

[11] Patent Number: 4,937,102

[45] Date of Patent: Jun. 26, 1990

[54] FABRICS HAVING HYDROPHILIC AND HYDROPHOBIC COATINGS

[75] Inventor: James M. Barnewall, Albany, N.Y.

[73] Assignee: Albany International Corp., Menands, N.Y.

[21] Appl. No.: 368,021

[22] Filed: Jun. 19, 1989

Related U.S. Application Data

[62] Division of Ser. No. 265,257, Oct. 31, 1988.

[51] Int. Cl.[5] ..... B05D 3/02; B05D 5/00

[52] U.S. Cl. ..... 427/244; 427/381; 427/389.9

[58] Field of Search ..... 427/381, 389.9, 244; 428/246, 280, 282, 304.4, 316.6

[56] References Cited

U.S. PATENT DOCUMENTS 4,102,190 7/1979 Ashworth ..... 428/288 X 4,759,976 7/1988 Dutt ..... 428/259 X

*Primary Examiner*—Michael Lusignaw

*Attorney, Agent, or Firm*—Kane, Dalsimer, Sullivan, Kurucz, Levy, Eisele & Richards

[57] ABSTRACT

This invention is directed to press fabrics having improved water removal capability. More particularly, this invention is directed to the improvement of the water removal capability of press fabrics by applying hydrophobic and/or hydrophilic layers of foam coatings. Even more particularly, this invention is directed to a method of modifying a fabric for a papermaking machine which comprises the steps of:

(a) applying a hydrophilic or hydrophobic foam coating to the surface of a fabric to form a layer thereon;

(b) drying said foam coating to form a layer;

(c) applying to said dried layer a hydrophobic foam coating if a hydrophilic foam coating was used in step (a) or a hydrophilic foam coating if a hydrophobic foam coating was used in step (a);

(d) drying said foam coating applied in step (c) to form a second layer;

(e) repeating steps (a) to (d) as necessary; and (f) curing the thus modified fabric.

8 Claims, No Drawings

FABRICS HAVING HYDROPHILIC AND HYDROPHOBIC COATINGS

This is a divisional of copending application Ser. No. 265,257 filed on Oct. 31, 1988.

FIELD OF THE INVENTION

This invention is directed to press fabrics having improved water removal capability. More specifically, this invention is directed to the improvement of the water removal characteristics of press fabric by applying hydrophobic foam and/or hydrophilic foam coatings.

BACKGROUND OF THE INVENTION

Papermakers' press fabrics are endless belts used for conveying a wet paper web from a forming zone, through a pressing zone, to a drying zone. In the pressing zone there is usually provided rotating cylindrical squeeze rolls between which the freshly formed paper web is passed. As the web enters the nip of the rolls, water is squeezed from the paper and is accepted by the press fabric upon which the paper is ccnveyed through the nip.

Papermakers' press fabrics are well known. Such fabrics are typically formed from materials such as wool, nylon, and/or other synthetic polymeric materials and the like. With such fabrics, the paper web, after passing through the nip of the pressing rolls, usually still contains an appreciable amount of water (50 to 64% water), which adds substantially to manufacturing costs due to the high energy required to evaporate the water during the subsequent drying stage. Improving the sheet water removal characteristics of the fabrics would thus be highly advantageous in that manufacturing costs would be reduced

OBJECTS OF THE INVENTION

It is an object of the invention to provide an improved press fabric.

It is also an object of the invention to provide a press fabric having enhanced water removal capability.

It is a further object of the invention to improve the water removal capability of the press fabric by applying hydrophobic and/or hydrophilic coatings thereto.

These and other objects of the invention will be more apparent in the discussion below.

DETAILED DESCRIPTION OF THE INVENTION

According to the present invention, there is provided a papermakers' press fabric for accepting water from a wet web of paper. The press fabric comprises an endless support and drainage medium comprised of fibrous material characterized in that the fabric comprises a layer having hydrophobic characteristics and/or a layer having hydrophilic characteristics, or a composite thereof.

It has been found that when a fabric according to the invention is used to convey a freshly formed paper web through the nip formed by pressing rolls, the amount of water remaining in the paper upon emergence from the nip can be much reduced. It is believed that this situation is due to the combination of hydrophilic and/or hydrophobic properties reducing the tendency for water to return to the paper web, phenomenon termed "rewet". Thus, since less water is left on the surface layers of the press fabric, less water is available to be returned to the paper web.

More specifically, according to the invention a press fabric is alternately coated with layers of hydrophilic and hydrophobic coating. The order of application, whether a hydrophobic coating or a hydrophilic coating is applied first, is not as important as the presence of layers of both the hydrophobic and hydrophilic resins. Further, more than one layer of one type can be applied before or after application of one or more layers of the other type.

The fabrics to be treated include those known in the art. Typical such fabrics are described in, for example, U.S. Pat. Nos. 2,354,435, 2,567,097, 3,059,312, 3,158,984, 3,425,392, 3,617,442, 3,657,068, and 4,382,987, and British Pat. No. 980,288, all of which are incorporated herein by reference.

Useful resin compositions include polyurethanes, polyether, polyester, polyisocyanate, polyolefins, polyacrylonitrile rubbers, polyacrylates, polyvinyl chlorides, epoxies, and the like, or a combination of two or more such polymeric resins. Typical of useful resin compositions are Emulsion 26172 (an acrylic emulsion representative of a large series of emulsions available from B. F. Goodrich) and Permuthane HD2004 (a water-based polyurethane emulsion available from C. L. Hauthaway)

Polyurethane coatings tend to be hydrophobic, and polyacrylic coatings tend to be hydrophilic. However, polyurethane foams can be made hydrophilic by addition of surfactant and/or detergent, or the like.

The resin coating composition can be prepared by admixing the various components and can then be applied as a liquid coating, foam, or froth.

According to the invention a coating is applied to a surface, or surfaces, of a press fabric and then allowed to dry and cure. The coating can be applied in one or more layers in conventional fashion.

Each layer is dried. After the topmost layer is dried, the coated fabric is cured by a suitable means. The temperature and time for drying or curing will be dependent upon the coating employed, manufacturing conditions, and the like.

The following examples are intended to illustrate the invention and should not be construed as limiting the invention thereto.

EXAMPLES

Example 1

Samples of DURAVENT TM press fabric (available from Albany International Corp., Felt Div.) were coated with alternating layers of a foam from polyurethane (available as Permuthane UE41-035 water based emulsion from C. L. Hauthaway) and polyacrylic (available as HYCAR 26138 from B. F. Goodrich). The foams were high blow ratio (low density) to keep from reducing air permeability excessively during application of several layers. Each successive coat was dried and cured before the next coat was added. Even after several coats, air permeability was reduced only slightly. Although a significant amount of resin was added, air permeability and felt stiffness were relatively unchanged.

Data for these samples is set forth in the following table:

TABLE I

| Sample | Coating** | % Add-On During Pass | Total Accumulated Add-On | Air Permeability (cfm/ft.$^2$) |
|---|---|---|---|---|
| A* | Uncoated | — | — | 16 |
| B | ACR Coating | 3.73 | 3.73 | 16 |
| C | ACR/PUR Coatings | 0.46 | 4.19 | 16 |
| D | ACR/PUR/ ACR Coatings | 1.10 | 5.29 | 15 |
| E* | Uncoated | — | — | 22 |
| F | PUR Coating | 3.09 | 3.09 | 16 |
| G | PUR/ACR Coating | 3.53 | 6.62 | 16 |
| H | PUR/ACR/ PUR Coating | 1.70 | 8.32 | 16 |

*Control
**"ACR" = polyacrylic foam coating; "PUR" = polyurethane foam coating

Example 2

A polyurethane foam, which tends to be hydrophobic, was made hydrophilic by adding 20% detergent to the emulsion and then foaming the mixture.

Layers of foam were applied to fabric samples. The first layer was hydrophobic polyurethane foam, the second layer was detergent loaded hydrophilic foam, and the final coating was the hydrophobic polyurethane foam. Each layer was dried prior to the addition of the next layer. After all layers were applied, the samples were cured at 300° F.

The resultant sandwich structures were washed and dried for several cycles. The samples wet up much more rapidly than untreated fabric samples.

After three layers were coated onto the fabrics the total add-on was nearly 15% solids. However, the results of air permeability tests set forth in the table below indicate that the fabrics were not appreciably closed up, i.e., the voids were not filled:

TABLE II

| Sample | Fabric | Air Permeability (cfm/sq.ft.) |
|---|---|---|
| A* | Uncoated | 20 |
| B | Coated | 20 |
| C* | Uncoated | 67 |
| D | Coated | 66 |

*Control

It follows that by coating a fabric with alternating layers of hydrophilic/hydrophobic foams, the hydrophilic/hydrophobic nature of the fabric structure and underlayer can be modified. Thus, the location and movement of water in the fabric structure could be controlled. In addition, sheet pickup and dewatering ability of the fabric should be improved, and there should be a reduced tendency to re-wet the sheet as the fabric and sheet emerge from the press nip.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A method of modifying a fabric for a papermaking machine which comprises the steps of:
   (a) applying a hydrophilic or hydrophobic polymeric foam coating to a surface of a fabric to form a layer thereon;
   (b) drying said foam coating to form a layer;
   (c) applying to said dried layer a hydrophobic foam coating if a hydrophilic foam coating was used in step (a) or a hydrophilic foam coating if a hydrophobic foam coating was used in step (a);
   (d) drying said foam coating applied in step (c) to form a second layer;
   (e) repeating steps (a) to (d) as necessary; and
   (f) curing the thus modified fabric.

2. The method of claim 1, wherein the hydrophobic foam coating is a polyurethane.

3. The method of claim 1, wherein the hydrophilic foam coating layer is a polyacrylic coating or a polyurethane coating containing one or more additives selected from the group consisting of surfactants, detergents, stabilizers, and emulsifiers.

4. The method of claim 1, wherein 2 or more foam layers are applied to the fabric.

5. The method of claim 1, wherein each foam layer is air dried at room temperature.

6. The method of claim 1, wherein the modified fabric is air dried at room temperature to cure it.

7. The method of claim 1, wherein the modified fabric is heated at elevated temperature for from about 1 minute to 5 hours.

8. A modified fabric prepared according to the method of claim 1.

* * * * *